US008492641B2

(12) United States Patent
Menzies-Gow

(10) Patent No.: US 8,492,641 B2
(45) Date of Patent: Jul. 23, 2013

(54) BOWING SENSOR FOR MUSICAL INSTRUMENT

(76) Inventor: Robert Dylan Menzies-Gow, Leicester (GB)

( * ) Notice: Subject to any disclaimer, the term of this patent is extended or adjusted under 35 U.S.C. 154(b) by 0 days.

(21) Appl. No.: 13/509,659

(22) PCT Filed: Oct. 14, 2010

(86) PCT No.: PCT/GB2010/001911

§ 371 (c)(1),
(2), (4) Date: May 14, 2012

(87) PCT Pub. No.: WO2011/061470

PCT Pub. Date: May 26, 2011

(65) Prior Publication Data

US 2012/0272814 A1 Nov. 1, 2012

(30) Foreign Application Priority Data

Nov. 17, 2009 (GB) ..... 0920120.3

(51) Int. Cl.
*G10H 3/06* (2006.01)

(52) U.S. Cl.
USPC ..... 84/724

(58) Field of Classification Search
USPC ..... 84/724
See application file for complete search history.

(56) References Cited

U.S. PATENT DOCUMENTS

| | | | | |
|---|---|---|---|---|
| 5,038,662 | A | 8/1991 | Ho | |
| 5,117,730 | A * | 6/1992 | Yamauchi | 84/723 |
| 5,265,516 | A | 11/1993 | Usa et al. | |
| 5,340,941 | A * | 8/1994 | Okamoto et al. | 84/658 |
| 5,396,025 | A * | 3/1995 | Tamura | 84/736 |
| 5,661,253 | A | 8/1997 | Aoki | |
| 6,720,949 | B1 | 4/2004 | Pryor et al. | |
| 8,017,851 | B2 * | 9/2011 | Horovitz et al. | 84/611 |
| 2004/0046736 | A1 | 3/2004 | Pryor et al. | |
| 2007/0126700 | A1 | 6/2007 | Wright | |
| 2009/0241753 | A1 | 10/2009 | Mann | |

FOREIGN PATENT DOCUMENTS

| | | | |
|---|---|---|---|
| JP | 09212162 | A | 8/1997 |
| JP | 10078778 | A | 3/1998 |
| WO | 2004093053 | A1 | 10/2004 |

OTHER PUBLICATIONS

Menzies, Dylan, "The CyberWhistle and O-Bow: Minimalist controllers inspired by traditional instruments," Retrieved at <<http://cec.concordia.ca/econtact/12_3/menzies_controllers.html>>, Canadian Electroacoustics Community—eContact!, Jun. 2010, pp. 1-6.

International Search Report mailed Feb. 2, 2011 for PCT Application No. PCT/GB2010/001911, pp. 1-3.

(Continued)

*Primary Examiner* — Jianchun Qin

(74) *Attorney, Agent, or Firm* — Medley, Behrens & Lewis, LLC

(57) ABSTRACT

The invention provides a music controller, in the form of a bowing sensor. The music controller includes a musical bow member (4) movable over a guide (2). Associated with the guide (2) is at least one optical flow sensor (6) for monitoring the speed and/or angle of the musical bow member (4) when it is moved longitudinally in contact with the guide, and optionally a pressure sensor (14) for monitoring the pressure of the bow member on the guide. That monitored data, combined with input from a keyboard or ribbon controller (16) enables an attached sound generating device (12) to generate sound that emulates the sound of a real bowed performance or other desired output.

20 Claims, 1 Drawing Sheet

Figure 1:
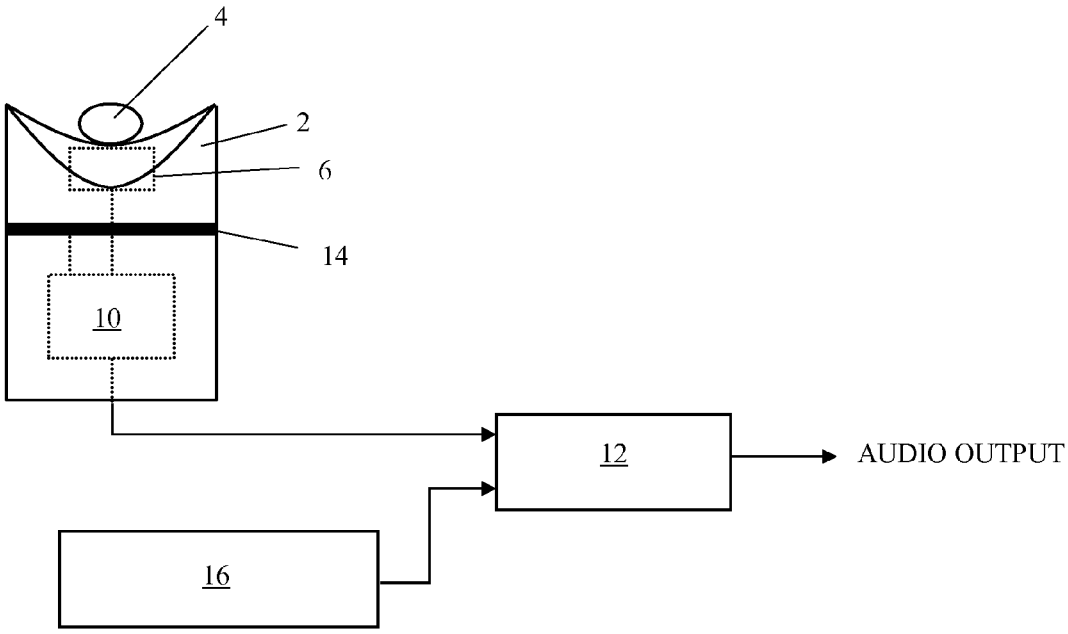

OTHER PUBLICATIONS
Combined Search and Examination Report dated Mar. 26, 2010 for United Kingdom Patent Application No. GB0920120.3, pp. 1-4.
Combined Search and Examination Report dated Feb. 15, 2011 for United Kingdom Patent Application No. GB1017332.6, pp. 1-6.
Response to Combined Search and Examination Report dated Jul. 15, 2011 for United Kingdom Patent Application No. GB1017332.6, pp. 1-10.

* cited by examiner

BOWING SENSOR FOR MUSICAL INSTRUMENT

CROSS-REFERENCE TO RELATED APPLICATION

This application is a U.S. national stage filing of Patent Cooperation Treaty (PCT) Application No. PCT/GB2010/001911 (WO 2011/061470), filed on Oct. 14, 2010, which claims priority to United Kingdom Patent Application No. GB0920120.3, filed on Nov. 17, 2009, the entireties of both of which are incorporated herein by reference.

FIELD OF THE INVENTION

The invention relates to a music controller in the form of a bowing sensor for bowed musical instrument emulation.

BACKGROUND ART

Music controllers are interface devices that are operated by a musician to produce musical sound in a similar way to performing on an acoustic musical instrument. The music controller generates signal data that can be used to control an electronic sound generating device. The music controller and the sound generating device together function as an electronic musical instrument. The sound generating device may emulate an acoustic musical instrument or produce an entirely synthetic sound, and can use a variety of synthesis methods including sample-playback and physical modelling. The most common types of music controller are keyboard devices which operate like a conventional piano keyboard but other types can be used to simulate bowed instruments. It is known for music controllers in the form of bowing sensors to use optical devices to track bow movement. Such music controllers require a specially prepared bow, either with finely spaced marks or a precise graduation of transparency. It is desirable therefore to find a simpler and more practical method of tracking bow movement.

SUMMARY OF THE INVENTION

The invention provides a music controller, being a bowing sensor for bowed musical stringed instrument emulation, comprising a musical bow member, a guide for the musical bow member, and at least one optical sensor associated with the guide for monitoring the speed and direction of the musical bow member whenever it is moved longitudinally in contact with the guide. The at least one optical sensor is preferably an optical flow sensor for capturing optical images of the musical bow member as it is moved across a surface of the optical flow sensor. The music controller compares successive captured optical images of the musical bow member to derive control data related to the speed and/or angle of the musical bow member relative to the guide.

The guide may be a fixed upright member across or against which the bow member is reciprocally moved and which serves to keep the bow member aligned with the optical flow sensor(s) while also allowing some freedom of movement. The speed and/or angle of that movement is accurately sensed and tracked by the optical flow sensor(s) associated with the guide. Such optical flow sensors are small, lightweight, inexpensive and extremely accurate. Similar sensors are in regular use in modern desktop computers, as part of the optical computer 'mouse'. They typically consist of a compact low-resolution video camera focused on the nearfield with an image processor that compares successive images that have been captured by the optical flow sensor and calculates the speed of the adjacent surface which in this case is the moving bow member. More particularly, a light source such as a light emitting diode (LED) or laser illuminates the adjacent surface resulting in a fine pattern that is captured as an image by the video camera. The image processor uses a suitable algorithm (e.g. a block matching algorithm) to compare successive images and calculate the speed and direction of the adjacent surface resulting in a relative measurement of displacement in two dimensions which can then be used to calculate the direction and speed at which the surface is moving. A variety of different optical flow sensors are available. Some use laser illumination and can track most kinds of surface up to speeds of several metres per second, which is well above the maximum bowing speed, and also have a resolution of several 1000 dots per inch enabling the capture of very fine movements. A microprocessor may be used to interface the optical flow sensor and its image processor to a sound generating device.

In use the bow member is drawn backwards and forwards across the surface of the optical flow sensor(s) and that movement is tracked by the music controller to derive control data related to the speed and/or angle of the bow member relative to the guide. The control data can be used by a sound generating device as described in more detail below. The speed of the musical bow member may be used to control gain and the angle of the bow member relative to the guide can be used to control vibrato intensity, for example. The angle of the bow member may be compared against a predetermined axis or line (e.g. a fixed axis of the guide) and the vibrato intensity in the electronic sound generating device may be varied according to the angular deviation from that predetermined axis or line. This provides unified control of bowing expression using just the bow member, without requiring any additional vibrato control. Learning good vibrato technique on a conventional acoustic bowed instrument is very challenging even though it is an important part of the overall playing technique. Likewise, producing cleanly bowed sound is difficult because this requires the initial bowing speed and force profile to be carefully controlled. The music controller of the present invention allows the constraints to be relaxed while still offering substantial expressive control.

The control data can include additional information relating to the operation of the bow member that is tracked or monitored by the music controller. For example, the control data can relate to one or more of: the direction of movement of the bow member, i.e. whether it is moving forwards or backwards across the optical flow sensor(s), even though this does not normally produce a significant musical effect in a conventional acoustic bowed instrument such as a violin; whether the bow member is in contact with either the guide or the surface of the optical flow sensor; and the pressure exerted by the bow member on the guide. In the latter case the music controller may further include a pressure sensor associated with the guide. The electronic sound generating device can use this additional information to emulate an acoustic bowed instrument more accurately, to produce an entirely synthetic sound, or to create novel effects.

The bow member may be anything from an actual musical bow, such as a bow for a stringed instrument of the violin family (which term includes violins, violas, cellos and double basses), to an elongate rod. In practice a simple wooden rod is extremely suitable. There is no need for the bow member to have finely spaced marks or a precise graduation of transparency to enable the music controller to track its movement.

In one arrangement the music controller can be combined with a conventional keyboard that is used to control the pitch of the generated sound. The other characteristics or auditory attributes of the generated sound are then preferably determined by the control data that is derived by the music controller. In a simple form the keyboard can be replaced with one or more simple switch pads that can select a pitch from a particular scale or a pitch that is determined externally, e.g. in response to a computer program or game.

In another arrangement the music controller can be combined with a ribbon controller that is able to detect the position of a finger on its length, or the absence of a finger, in a similar way to a fingerboard. The ribbon controller may therefore be used to control the pitch of the generated sound on a continuous scale. Vibrato effects can optionally be provided through the ribbon controller as well as through the angle of the bow member. The guide of the music controller and the ribbon controller may be held together as a single device in the manner of a conventional acoustic bowed instrument. Multiple ribbon controllers can be mounted side by side in order to emulate the arrangement of multiple strings on a conventional acoustic bowed instrument. Each ribbon controller may be associated with its own optical flow sensor to emulate bowing contact on separate strings. This allows sounds to be generated for each ribbon controller only when the bow member is drawn backwards and forwards across the surface of the associated optical flow sensor. If the bow member is drawn backwards and forwards across the surface of two or more optical flow sensors then two separately pitched sounds can be generated.

If the bow member is not moving relative to the guide but remains in contact with either the guide or the surface of the optical flow sensor(s) then the generated sound can cease. If the bow member is no longer in contact with either the guide or the surface of the optical flow sensor(s) then in certain situations this can be used to simulate a ringing open string to emulate a conventional acoustic bowed instrument. It may be possible to detect whether the bow member has come to a stop or has been lifted off the surface of the optical flow sensor(s) by analysing the final image captured by the optical flow sensor or the movement characteristics of the bow member (e.g. its speed profile) as it comes to a stop, for example.

The control data may be provided to a sound generating device (e.g. an external sound generating device such as a computer or synthesiser) which generates the desired sound having a pitch that is determined by the keyboard or ribbon controller. The other characteristics or auditory attributes of the generated sounds are determined by the control data, which may optionally be filtered or processed before it is used by the sound generating device. The generated sound may be based on a sample of actual recordings of bowed instruments of the violin family. However, the sample library that is used by the sound generating device may include sound samples of non-existent or imaginary musical instruments or other sound sources, being sound samples created electronically for example. Bowing-like modifications to the basic sounds so created could be recorded and stored, and the music controller of the invention could then be used to access those sounds. The sound generating device may use algorithms that model the physical processes in instruments and do not require samples. These algorithms can provide very realistic behaviour and can also be modified to create instruments that are unlike any existing acoustic instruments. Moreover, the sound generating device can use any kind of sound synthesis producing sound that may or may not resemble that of acoustic bowed instruments. The music controller of the invention can therefore provide to a composer or sound producer complex articulations with new sounds, thereby creating a powerful new concept for music producers.

DRAWINGS

Figure 2A:
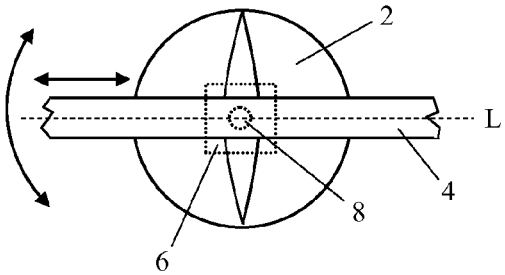
Figure 2B:
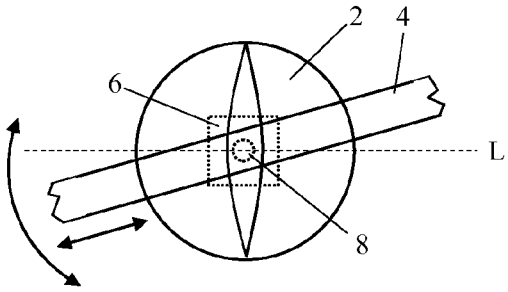

FIG. 1 shows a side view of a bowing sensor according to the present invention; and FIGS. 2A and 2B show top views of the bowing sensor of FIG. 1.

With reference to FIG. 1, a bowing sensor includes a guide member 2 with a profiled upper surface that is designed to receive a bow member 4. The bow member 4 can have any suitable construction but in the illustrated embodiment it is a wooden rod. The guide member 2 incorporates an optical flow sensor 6 that includes a light source and a compact low-resolution video camera. The optical flow sensor 6 captures images of the bow member 4 as it is passed backwards and forwards over a surface or window 8 of the optical flow sensor. An image processor that is associated with the optical flow sensor 6 compares successive images and uses them to calculate the speed of the bow member relative to the guide member 2. A microprocessor 10 then interfaces the optical flow sensor 6 to a sound generating device 12 as described in more detail below. FIG. 2A shows how the bow member 4 can be moved backwards and forwards along a longitudinal axis L of the guide member 2. The bow member 4 can also be moved backwards and forwards at an angle to the axis L as shown in FIG. 2B. The image processor can compare successive images captured by the optical flow sensor 6 and use them to calculate the angle of the bow member 4 relative to the axis L.

The microprocessor 10 interfaces with the optical flow sensor 6 and can provide control data to a sound generating device 12 such as a computer or synthesiser which can be used to derive an audio output. The control data may be indicative of the speed of the bow member 4 and/or the angle of the bow member as calculated using the images captured by the optical flow sensor 6. The control data may also be indicative of the pressure exerted by the bow member 4 on the guide member 2 which can be sensed by a pressure sensor 14 associated with the guide member. The way in which the bow member 4 is moved across the guide member 2 can therefore be used to control characteristics or auditory attributes of the audio output of the sound generating device 12 such as gain, vibrato intensity etc.

The keyboard or ribbon controller 16 is also connected to the sound generating device 12 and is used to control the pitch of the audio output of the sound generating device.

The invention claimed is:

1. A music controller, being a bowing sensor for bowed musical stringed instrument emulation, comprising:

a musical bow member, a guide for the musical bow member, and at least one optical flow sensor associated with the guide, the at least one optical flow sensor capturing optical images of the musical bow member as it is moved across a surface of the optical flow sensor regardless of whether the musical bow member includes features designed for tracking the musical bow member as it is moved across the surface of the optical flow sensor, wherein the music controller compares successive captured optical images of the musical bow member to derive control data related to the speed and/or angle of the musical bow member relative to the guide, wherein the guide is configured to maintain the musical bow member in alignment with the at least one optical flow sensor as it is moved across the surface of the optical flow sensor, wherein the musical bow member is in alignment with the at least one optical flow sensor when the at least one optical flow sensor captures an optical image of a portion of the musical bow member while a disparate portion of the musical bow member is not captured in the optical image.

2. A music controller according to claim 1, further comprising at least one pressure sensor associated with the guide for monitoring the pressure exerted by the musical bow member.

3. A music controller according to claim 2 in combination with a keyboard in which the pitch of generated sounds is determined by the keyboard and other characteristics or auditory attributes of the generated sounds are determined by the control data that is derived by the music controller.

4. A music controller according to claim 2 in combination with at least one ribbon controller in which the pitch of generated sounds is determined by the one or more ribbon controllers and other characteristics or auditory attributes of the generated sounds are determined by the control data that is derived by the music controller.

5. A music controller according to claim 2 in combination with a plurality of ribbon controllers, the musical controller having a plurality of optical flow sensors and each ribbon controller being associated with a respective one of the plurality of optical flow sensors, in which the pitch of generated sounds is determined by the ribbon controllers and other characteristics or auditory attributes of the generated sounds are determined by the control data that is derived by the music controller.

6. A music controller according to claim 1, wherein the control data is further related to the direction and/or pressure of the musical bow member across the surface of the optical flow sensor.

7. A music controller according to claim 6 in combination with a keyboard in which the pitch of generated sounds is determined by the keyboard and other characteristics or auditory attributes of the generated sounds are determined by the control data that is derived by the music controller.

8. A music controller according to claim 1, wherein the musical bow member is an actual musical bow for a stringed instrument of the violin family.

9. A music controller according to claim 1, wherein the musical bow member is an elongate rod of a rigid material.

10. A music controller according to claim 9, wherein the musical bow member is a wooden rod.

11. A music controller according to claim 1 in combination with a keyboard in which the pitch of generated sounds is determined by the keyboard and other characteristics or auditory attributes of the generated sounds are determined by the control data that is derived by the music controller.

12. A music controller according to claim 1 in combination with at least one ribbon controller in which the pitch of generated sounds is determined by the one or more ribbon controllers and other characteristics or auditory attributes of the generated sounds are determined by the control data that is derived by the music controller.

13. A music controller according to claim 1 in combination with a plurality of ribbon controllers, the musical controller having a plurality of optical flow sensors and each ribbon controller being associated with a respective one of the plurality of optical flow sensors, in which the pitch of generated sounds is determined by the ribbon controllers and other characteristics or auditory attributes of the generated sounds are determined by the control data that is derived by the music controller.

14. A music controller according to claim 1 in combination with a sound generating device for generating sounds.

15. A music controller according to claim 1, wherein the guide is a saddle-shaped guide.

16. A music controller, being a bowing sensor for bowed musical stringed instrument emulation, comprising:

a musical bow member, a saddle-shaped guide for the musical bow member, and at least one optical flow sensor associated with the saddle-shaped guide, the at least one optical flow sensor capturing optical images of the musical bow member as it is moved across a surface of the optical flow sensor regardless of whether the musical bow member includes features designed for tracking the musical bow member as it is moved across the surface of the optical flow sensor, wherein the music controller compares successive captured optical images of the musical bow member to derive control data related to the speed and/or angle of the musical bow member relative to the guide, wherein the saddle-shaped guide is configured to maintain the musical bow member in alignment with the at least one optical flow sensor as it is moved across the surface of the optical flow sensor, wherein the musical bow member is in alignment with the at least one optical flow sensor when the at least one optical flow sensor captures an optical image of a portion of the musical bow member while a disparate portion of the musical bow member is not captured in the optical image.

17. A musical controller according to claim 16, further comprising at least one pressure sensor associated with the guide for monitoring the pressure exerted by the musical bow member.

18. A musical controller according to claim 16, wherein the control data is further related to the direction and/or pressure of the musical bow member across the surface of the optical flow sensor.

19. A musical controller according to claim 16 in combination with a keyboard in which the pitch of generated sounds is determined by the keyboard and other characteristics or auditory attributes of the generated sounds are determined by the control data that is derived by the music controller.

20. A musical controller according to claim 16 in combination with at least one ribbon controller in which the pitch of generated sounds is determined by the one or more ribbon controllers and other characteristics or auditory attributes of the generated sounds are determined by the control data that is derived by the music controller.

* * * * *